United States Patent [19]

Kwant et al.

[11] 4,201,659

[45] May 6, 1980

[54] PROCESS FOR THE PREPARATION OF GAS OIL

[75] Inventors: Pieter B. Kwant, Amsterdam; Dirk Kanbier, The Hague; Petrus W. H. L. Tjan, Amsterdam; Mohammed Akbar, The Hague, all of Netherlands

[73] Assignee: Shell Oil Company, Houston, Tex.

[21] Appl. No.: 43,187

[22] Filed: May 29, 1979

[30] Foreign Application Priority Data

Jul. 7, 1978 [NL] Netherlands ..... 7807357

[51] Int. Cl.[2] ..... C10G 37/04

[52] U.S. Cl. ..... 208/73; 208/49; 208/77; 208/80; 208/86; 208/92; 208/94; 208/95

[58] Field of Search ..... 208/77, 72, 76, 89, 208/73, 80, 86

[56] References Cited

U.S. PATENT DOCUMENTS

| | | | |
|---|---|---|---|
| 2,943,050 | 6/1960 | Beavon | 208/309 |
| 3,053,751 | 9/1962 | Garwin | 208/45 |
| 3,254,020 | 5/1966 | Frayer et al. | 208/89 |
| 4,039,429 | 8/1977 | Klinken et al. | 208/50 |
| 4,062,758 | 12/1977 | Goudriaan et al. | 208/80 |
| 4,120,778 | 10/1978 | Goudriaan et al. | 208/80 |
| 4,126,538 | 11/1978 | Goudriaan et al. | 208/80 |

OTHER PUBLICATIONS

Medlin et al., "Process Feed for More CAT Gasoline," Petroleum Refiner, May 1958, pp. 167–172.

"Combination Unit," Foster-Wheeler Corp., Petroleum Refiner, Sep. 1958, p. 249.

Shell Int. Res., "Combined Thermal Cracking-Deasphalting Process," LAPIS, Aug. 1964, p. 26.

"Vis breaking," M. W. Kellogg Co., Hydrocarbon Processing, Sep. 1974, p. 123.

*Primary Examiner*—Delbert E. Gantz
*Assistant Examiner*—G. E. Schmitkons
*Attorney, Agent, or Firm*—Ronald R. Reper

[57] ABSTRACT

A process is disclosed for the conversion of asphaltines-containing mineral hydrocarbon oil to distillate gas oil by a processing sequence comprising thermal cracking, flashing, atmospheric fractionation, vacuum fractionation, thermal cracking, catalytic cracking or hydrocracking, and atmospheric fractionation with certain recycle of intermediate streams to achieve efficient, economic operations.

13 Claims, 1 Drawing Figure

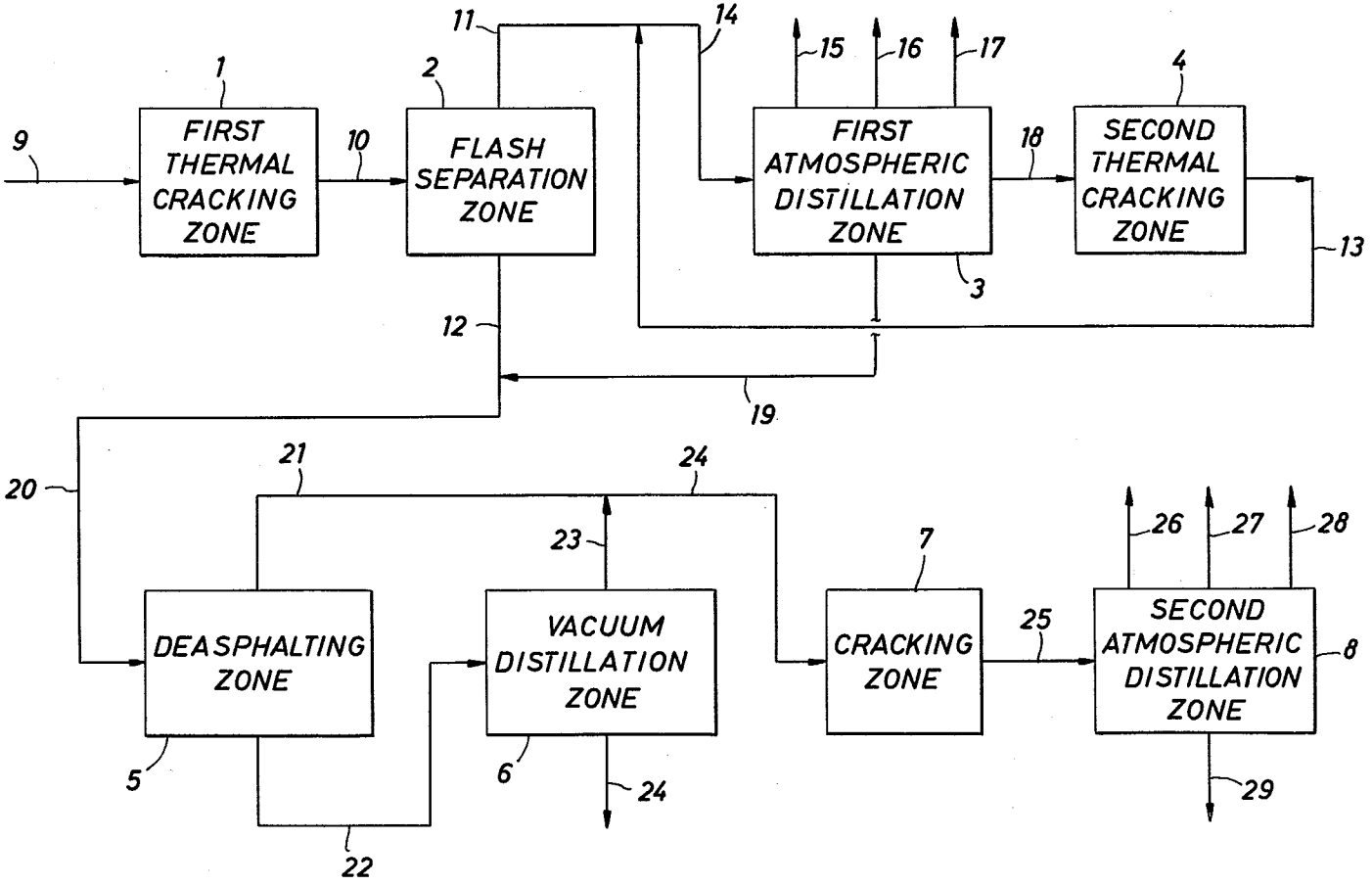
FIRST THERMAL CRACKING ZONE
FLASH SEPARATION ZONE
FIRST ATMOSPHERIC DISTILLATION ZONE
SECOND THERMAL CRACKING ZONE
DEASPHALTING ZONE
VACUUM DISTILLATION ZONE
CRACKING ZONE
SECOND ATMOSPHERIC DISTILLATION ZONE
1
2
3
4
5
6
7
8
9
10
11
12
13
14
15
16
17
18
19
20
21
22
23
24
24
25
26
27
28
29

PROCESS FOR THE PREPARATION OF GAS OIL

BACKGROUND OF THE INVENTION

The invention relates to a process for the preparation of gas oil from an asphaltenes-containing hydrocarbon oil by thermal cracking.

In the atmospheric distillation of crude mineral oil, as practiced on a large scale in refineries for the preparation of gasolines, kerosines and gas oils, an asphaltenes-containing oil is obtained as a by-product. In view of the increasing need for the above-mentioned hydrocarbon oil distillates and the decreasing reserves of crude mineral oil, several processes were proposed in the past aiming at the conversion of the asphaltenes-containing oils, which were at first used substantially as fuel oil, into hydrocarbon oil distillates. Examples of such processes are catalytic cracking, thermal cracking, gasification in combination with hydrocarbon synthesis, coking, and hydrocracking. In the past, the employer of the present applicant developed an attractive process for the preparation of gas oil from asphaltenes-containing hydrocarbon oils by thermal cracking. This process is carried out in an apparatus which comprises the first thermal cracking unit, a cyclone unit, an atmospheric distillation unit (in which, if desired, the distillation can be carried out at a maximum pressure of 5 bar), and the second thermal cracking unit. In the process the asphaltenes-containing hydrocarbon oil is converted in the first thermal cracking unit into a cracked product which consists of 5–30% w of components boiling below the boiling range of the feed. The cracking product is phase separated by flashing in the cyclone unit into a light fraction boiling substantially below 500° C. and which contains, in addition to components boiling below 350° C., both light and heavy components boiling between 350° and 500° C., and into a heavy fraction boiling substantially above 350° C. and which contains, in addition to components boiling above 500° C., both light and heavy components boiling between 350° and 500° C. The light fraction from the cyclone unit is mixed with the cracking product from the second thermal cracking unit and the mixture is separated in the atmospheric distillation unit into a number of light distillate fractions of which the heaviest is the desired gas oil, a heavy distillate fraction and a residual fraction. The heavy distillate fraction from the atmospheric distillation unit is converted in the second thermal cracking unit into a cracking product which consists of 20–75% w of components boiling below the boiling range of the feed for the first thermal cracking unit.

Although the above-described process offers the possibility of preparing a high-grade gas oil from an asphaltenes-containing hydrocarbon oil as the starting material, it has the drawback that the yield of atmospheric distillates is low. The applicants now have carried out an investigation to find measures by which the yield of atmospheric distillates can be increased using the above-described process. In this investigation it was found that the residual fraction which is separated in the atmospheric distillation unit consists to a considerable extent of components which are very suitable for use as the feed for a catalytic cracking plant or as the feed for a hydrocracking plant for the preparation of atmospheric hydrocarbon oil distillates, such as gasolines, kerosenes, and gas oils. These components may be isolated from the residual fraction by subjecting the latter to vacuum distillation and by subjecting the vacuum residue obtained in this vacuum distillation to deasphalting. Both the vacuum distillate and the deasphalted oil were found very suitable for use as the feed for a catalytic cracking or a hydrocracking plant.

SUMMARY OF THE INVENTION

The present application therefore relates to a process for the preparation of gas oil from an asphaltenes-containing hydrocarbon oil, which comprises (a) thermally cracking said asphaltenes-containing oil in a first thermal cracking zone at a temperature from about 400° to 500° C. and a pressure from about 1 to about 30 bar to obtain a first cracked product comprising 5 to 30% w on said asphaltenes-containing oil of thermally cracked material boiling at a temperature lower than the boiling range of said asphaltenes-containing oil, (b) separating said first cracked product by flashing in a phase separation zone into (i) a light fraction boiling substantially below 500° C. which contains in addition to components boiling below 350° C., additional components boiling between 350° and 500° C., and (ii) a heavy fraction boiling substantially above 350° C. which contains in addition to components boiling above 500° C., additional components boiling between 350° and 500° C., (c) separating the light fraction from step (b) by fractionation distillation in a first atmospheric distillation zone into (i) at least one light distillate fraction, (ii) a heavy distillate fraction, and (iii) a residual fraction, (d) separating said residual fraction from step (b) by vacuum distillation in a vacuum distillation zone into a vacuum distillate and a vacuum residue, (e) thermally cracking the heavy distillate fraction from step (c) in a second thermal cracking zone at a temperature from about 400° to 550° C. and a pressure from about 1 to 30 bar to obtain a second thermally cracked product comprising from about 20 to 75% w of components boiling below the boiling range of said asphaltenes-containing oil feed to step (a), (f) recycling said product from step (e) as feed to step (c) along with the light fraction, (g) cracking the vacuum distillate from step (d) in a cracking zone which is either a catalytic cracking zone or a hydrocracking zone to obtain a cracked product, and (h) separating the cracked product of step (g) by fractionation distillation in a second atmospheric distillation zone to obtain at least one distillate gas oil fraction and an atmospheric residue.

BRIEF DESCRIPTION OF THE DRAWING

The drawing schematically illustrates an embodiment of the processing scheme accroding to the invention.

DESCRIPTION OF PREFERRED EMBODIMENTS

In the process according to the invention the, starting material should be an asphaltenes-containing hydrocarbon oil as the feed for the first thermal cracking unit. Examples of suitable asphaltenes-containing hydrocarbon oils are atmospheric residues and vacuum residues obtained in the distillation of crude mineral oil, mixtures of atmospheric residues, mixtures of vacuum residues, mixtures of atomspheric residues with vacuum residues, and mixtures of atmospheric and/or vacuum residues with distillates obtained in the vacuum distillation of atmospheric residues. The asphaltenes-containing hydrocarbon oil that is preferably used is an atmospheric distillation residue of a crude mineral oil.

In the process according to the invention, it is preferred to operate the first thermal cracking unit at a temperature between 400° and 500° C. and the second thermal cracking unit at a temperature between 400° and 550° C. Both thermal cracking units are preferably operated at an elevated pressure, such as a pressure between 1 and 30 bar. With respect to the conversion that takes place in the two cracking units, it can be observed that preference is given to the use of such cracking conditions in the first and the second thermal cracking unit that cracking products are obtained which consist of 10–30% w and 20–60% w, respectively, of components boiling below the boiling range of the feed for the first thermal cracking unit.

Although, according to the invention, it is possible in principle to incorporate into the apparatus in which the process is carried out, both a catalytic cracking unit and a hydrocracking unit and, for instance, to subject the vacuum distillate prepared from the residual fraction from the first atmospheric distillation unit to catalytic cracking and to subject the deasphalted oil prepared from the residual fraction from the first atmospheric distillation unit to hydrocracking, it is preferred to incorporate only one of these cracking units into the apparatus. The process according to the invention can very conveniently be carried out by using a mixture of a vacuum distillate and a deasphalted oil prepared from the residual fraction from the first atmospheric distillation unit as the feed for either a catalytic cracking unit or a hydrocarcking unit.

In the investigation by the applicant concerning measures for increasing the yield of atmospheric distillates, it has further been found that the heavy fraction that is separated in the cyclone unit also consists to a considerable extent of components which are very suitable for use as the feed for a catalytic and/or hydrocracking plant. These components can be separated from the heavy fraction by subjecting the latter to vacuum distillation and by subjecting the vacuum residue obtained in this vacuum distillation to deasphalting. Both the vacuum distillate and the deasphalted oil have been found very suitable for use as the feed for a catalytic and/or hydrocracking plant.

The process according to the invention can therefore very conveniently be carried out by using, in addition to a vacuumm distillate and/or deasphalted oil mixture prepared from the residual faction from the first atmospheric distillation unit, also a vacuum distillate and/or a deasphalted oil prepared from the heavy fraction from the cyclone unit as the feed for the catalytic or hydrocracking unit. If the aim is to use, in addition to a vacuum distillate prepared from the residual fraction from the first atmospheric distillation unit, also a vacuum distillate prepared from the heavy fraction from the cyclone unit as the feed for the catalytic or hydrocracking unit, the vacuum distillation can very conveniently be applied to a mixture of the residual fraction from the first atmospheric distillation unit and the heavy fraction from the cyclone unit. If the aim is to use, in addition to a vacuum distillate/deasphalted oil mixture prepared from the residual fraction from the first atmospheric distillation unit, also a vacuum distillate/deasphalted oil mixture prepared from the heavy fraction from the cyclone unit as the feed for the catalytic or hydrocracking unit, the vacuum distillation and ensuing deasphalting can very conveniently be applied to a mixture of the residual fraction from the first atmospheric distillation unit and the heavy fraction from the cyclone unit.

In the process according to the invention, a vacuum distillate and/or a deasphalted oil is subjected to catalytic or hydrocracking which is preferably carried out in the presence of a zeolitic catalyst, coke is deposited on the catalyst. This coke is removed from the catalyst by burning it off during a catalyst regeneration combined with the catalytic cracking. The catalytic cracking is preferably carried out at an average temperature of from 400° to 550° C. and particularly from 450° to 525° C., a pressure from 1 to 10 bar and particularly from 1.5 to 7.5 bar and a space velocity of from 0.25 to 6 $kg.kg^{-1}.h^{-1}$ and particularly from 0.5 to 0.4 $kg.kg^{-1}.h^{-1}$.

Hydrocracking, which can be used in the process according to the invention, takes place by contacting the feed at elevated temperature and pressure and in the presence of hydrogen with a suitable hydrocracking catalyst. The hydrocracking is preferably carried out as a two-step process in which the hydrocracking proper which takes place in the second step is preceded by a catalytic hydrotreatment with the main object of reducing the nitrogen and the polyaromatics content of the feed to be hydrocracked. Suitable catalysts for use in a one-step hydrocracking process and in the second step of a two-step hydrocracking process are moderately acid and strongly acid catalysts which contain one or more metals having hydrogenation activity on a carrier. Suitable catalysts for use in the first step of a two-step hydrocracking process are weakly acid and moderately acid catalysts which contain one or more metals having hydrogenation activity on a carrier. Hydrocracking is preferably carried out at an average temperature of from 250° to 450° C. and particularly from 300° to 425° C., a hydrogen partial pressure of from 25 to 300 bar and particularly from 50 to 150 bar, a space velocity of from 0.1 to 10 $kg.1^{-1}.h^{-1}$ and particularly from 0.25 to 2 $kg.1^{-1}.h^{-1}$ and a hydrogen/feed ratio of from 200 to 3,000 $Nl.kg^{-1}$ and a hydrogen/feed ratio of from 200 to 3,000 $Nl.kg^{-1}$ and particularly of from 500 to 2,000 $Nl.kg^{-1}$. When hydrocracking is carried out according to the two-step process, the complete reaction product from the first step (without ammonia, hydrogen sulphide or other volatile components being separated from it) is preferably used as the feed for the second step.

The product obtained in the process according to the invention by catalytic cracking or hydrocracking is separated in the second atmospheric distillation unit into a number of light distillate fractions of which the heaviest is the desired gas oil and an atmospheric residue. To increase the yield of atmospheric distillates, this residue may be recycled to the catalytic or hydrocracking unit. The residue can also very conveniently be used as feed component for the second thermal cracking unit.

If in the process according to the invention use is made of deasphalting, this is preferably effected by using butane as the solvent, particularly at a solvent/oil weight ratio greater than 1.0.

Two process schemes for the preparation of gas oil from an asphaltenes-containing hydocarbon oil according to the invention will be explained in more detail below with reference to the attached figures.

Process Scheme I (See Figure)

The process is carried out in an apparatus comprising, successively, the first thermal cracking zone (1), a cyclone flashing zone (2), an atmospheric distillation zone (3), a second thermal cracking zone (4), a vacuum distillation zone (5), a deasphalting zone (6), a catalytic cracking zone (7), and the second atmospheric distillation zone (8). An asphaltenes-containing hydrocarbon oil residue (9) obtained by atmospheric distillation is thermally cracked, and the cracked product (10) is separated into a light fraction (11) and a heavy fraction (12). The light fraction (11) is mixed with a cracking product (13), and the mixture (14) is separated into a gas stream (15), a gasoline fraction (16), a gas oil fraction (17), a heavy distillate fraction (18), and a residual fraction (19). The heavy fraction (12) and the residual fraction (19) are mixed. The mixture (20) is separated into a vacuum distillate (21) and a vacuum residue (22) and the vacuum residue (22) is separated further into a deasphalted oil (23) and bitumen (24). The vacuum distillate fraction (21) is mixed with the deasphalted oil (23) and the mixture (24) is catalytically cracked. The cracked product (25) is separated by atmospheric distillation into a gas stream (26), a gasoline fraction (27), a gas oil fraction (28), and a residue (29).

Process Scheme II (See Figure)

The process is carried out in substantially the same way as described under process scheme I with these differences, that in the present case the vacuum distillation unit (6), the deasphalting unit (5), the catalytic cracking unit (7), and the second atmospheric distillation unit (8) are omitted and that the heavy fraction (12) and the residual fraction (19) are discharged from the process as products instead of being further processed.

The present patent application also comprises equipment for carrying out the process according to the invention, substantially equal to that described under process schemes I and II.

The invention will now be explained with reference to the following three examples. Of these, examples 1 and 2 are examples according to the invention. Example 3 is outside the scope of the invention and has been included in the application for the sake of comparison. In the examples, an atmospheric distillation residue of a crude mineral oil with an initial boiling point of 350° C. was used as the feed. In the first thermal cracking unit, the temperature was 480° C. and the pressure 5 bar. In the second thermal cracking unit, the temperature was 490° C. and the pressure 20 bar. The desphalting used in examples 1 and 2 was carried out at a temperature of from 130° to 150° C. and a pressure of 40 bar with butane as the solvent and at a butane/oil weight ratio of 2.0. The catalytic cracking used in example 1 was carried out at a temperature of 485° C., a pressure of 3 bar, and a space velocity of 3 $kg.kg^{-1}.h^{-1}$ and using a zeolitic catalyst. The hydrocracking used in example 2 was carried out in two steps in which the complete reaction product from the first step was used as the feed for the second step. Both steps were carried out at a temperature of 380° C., a hydrogen partial pressure of 120 bar, a space velocity of 1 $1.1^{-1}.h^{-1}$ and a $H_2$/oil ratio of 1,500 $Nl.kg^{-1}$. In the first step an $Ni/Mo/Al_2O_3$ catalyst was used, and in the second step an Ni/W/faujasite catalyst. With respect to the composition of the streams (11), (12), and (13) mentioned in the examples, the following can be observed:

Stream (11) consisted of 30% w of components boiling below 350° C. and of 60% w of components boiling between 350° and 500° C.

Stream (12) consisted of 60% w of components boiling above 500° C. and of 35% w of components boiling between 350° and 500° C.

Stream (13) consisted of 40% w of components boiling below 350° C.

EXAMPLE 1

This example was carried out according to process scheme I. With 100 pbw of the 350° C.+ atmospheric distillation residue (9) as the starting material, the following quantities of the various streams were obtained:

46 pbw light fraction (11),
54 pbw heavy fraction (12),
4 pbw $C_4$- gas stream (15),
7 pbw $C_5$-165° C. gasoline fraction (16),
23 pbw 165°-350° C. oil fraction (17),
51 pbw heavy distillate fraction (18),
12 pbw residual fraction (19),
23 pbw vacuum distillate (21),
17 pbw deasphalted oil (23),
26 pbw bitumen (24),
4 pbw $C_4$- gas stream (26),
14 pbw $C_5$-165° C. gasoline fraction (27),
13 pbw 165°-350° C. gas oil fraction (28), and
9 pbw 350° C.+ residue (29).

EXAMPLE 2

This example was carried out according to process scheme II. With 100 pbw of the 350° C.+ atmospheric distillation residue (9) as the starting material, the same quantities of the streams (11), (12), (15), (16), (17), (18), (19), (21), and (22) were obtained as in example 1. The quantities of the other streams were:

1 pbw $C_4$- gas fraction (26),
9 pbw $C_5$-165° C. gasoline fraction (27),
6 pbw 165°-350° C. gas oil fraction (28), and
7 pbw 350° C.+ residue (29).

EXAMPLE 3

This example was carried out according to process scheme III. With 100 pbw of the 350° C.+ atmospheric distillation residue (9) as the starting material, the same quantities of the streams (11), (12), (15), (16), (17), (18), and (19) were obtained as in example 1.

We claim as our invention:

1. A process for the preparation of gas oil from an asphaltenes-containing residual hydrocarbon oil which comprises (a) thermally cracking said asphaltenes-containing oil in a first thermal cracking zone at a temperature from about 400° to 500° C. and a pressure from about 1 to about 30 bar to obtain a first cracked product comprising 5 to 30% w on said asphaltenes-containing oil of thermally cracked material boiling at a temperature lower than the boiling range of said asphaltenes-containing oil, (b) separating said first cracked product by flashing in a phase separation zone into (i) a light fraction boiling substantially below 500° C. which contains in addition to components boiling below 350° C., additional components boiling between 350° and 500° C., and (ii) a heavy fraction boiling substantially above 350° C. which contains in addition to components boiling above 500° C., additional components boiling between 350° and 500° C., (c) separating the light fraction from step (b) by fractionation distillation in a first atmospheric distillation zone into
(i) at least one light distillate fraction,
(ii) a heavy distillate fraction, and
(iii) a residual fraction, (d) separating said residual fraction from step (b) by vacuum distillation in a vacuum distillation zone into a vacuum distillate and a vacuum residue, (e) thermally cracking the heavy distillate fraction from step (c) in a second thermal cracking zone at a temperature from about 400° to 550° C. and a pressure from about 1 to 30 bar to obtain a second thermally cracked product comprising from about 20 to 75% w of components boiling below the boiling range of said asphaltenes-containing oil free to step (a), (f) recycling said product from step (e) as feed to step (c) along with the light fraction, (g) cracking the vacuum distillate from step (d) in a cracking zone which is either a catalytic cracking zone or a hydrocracking zone to obtain a cracked product, and (h) separating said cracked product by fractionation distillation in a second atmospheric distillation zone to obtain at least one distillate gas oil fraction and an atmospheric residue.

2. A process according to claim 1 wherein the feed to step (a) is an atmospheric distillation residue of a crude mineral oil.

3. A process according to claim 1 wherein such cracking conditions are used in the first and second thermal cracking zones that cracking products are obtained which consist of 10–30% w and 20–60% w, respectively, of components boiling below the boiling range of the asphaltenes-containing oil feed for the first thermal cracking zone.

4. A process according to claim 1 wherein the heavy fraction from the phase separation zone in step (b) is separated by vacuum distillation into a vacuum distillate and a vacuum residue, and in a deasphalting zone, vacuum residue is separated by deasphalting into a deasphalted oil and bitumen and that the vacuum distillate so obtained and the deasphalted oil so obtained are used as feed components for the cracking zone of step (g).

5. A process according to claim 4 wherein the vacuum distillation is applied to a mixture of the heavy fraction from the phase separation zone of step (b) and the residual fraction from the first atmospheric distillation zone of step (e) and that the vacuum distillate product is used as the feed to the cracking zone of step (g).

6. A process according to claim 4 wherein the vacuum distillation and ensuing deasphalting, are applied to a mixture of the heavy fraction from the phase separation zone of step (b) and to the residual fraction from the first atmospheric distillation zone of step (c) and that the vacuum distillate so obtained and the deasphalted oil so obtained are used as the feed to the cracking zone of step (g).

7. A process according to claim 1 wherein step (g), the catalytic cracking is carried out at an average temperature of from 400 to 550° C., a pressure of from 1 to 10 bar, and a space velocity of from 0.25 to 6 $kg.kg^{-1}.h^{-1}$.

8. A process according to claim 1 wherein step (g), hydrocracking is carried out at an average temperature of from 250° to 450° C., a hydrogen partial pressure of from 25 to 300 bar, a space velocity of from 0.1 to 10 $kg.1^{-1}.h^{-1}$, and a hydrogen/feed ratio of from 200 to 3,000 $Nl.kg^{-1}$.

9. A process according to claim 8 wherein the hydrocracking is carried out as a two-step process in which the complete reaction product from the first step is used as the feed for the second step.

10. A process according to claim 1 wherein the residue in step (h) from the second atmospheric distillation zone is recycled to the cracking zone of step (g).

11. A process according to claim 1 wherein the residue from step (h) the second atmospheric distillation zone is recycled as a feed component for the second thermal cracking zone in step (e).

12. A process according to claim 1 wherein the vacuum residue from step (d) is separated by deasphalting in a deasphalting zone into a deasphalted oil and bitumen and the deasphalted oil is used as feed to the cracking zone of step (g) and the bitumen is withdrawn from the process.

13. A process according to claim 12 wherein the deasphalting is effected by using butane as the solvent, at a solvent/oil weight ratio greater than 1.0.

* * * * *